US006121893A

United States Patent [19]

Park

[11] Patent Number: 6,121,893

[45] Date of Patent: Sep. 19, 2000

[54] REMOTE CONTROL RECEIVING SYSTEM

[75] Inventor: Jae-ho Park, Yongin, Rep. of Korea

[73] Assignee: Samsung Electronics Co., Ltd., Rep. of Korea

[21] Appl. No.: 09/136,545

[22] Filed: Aug. 19, 1998

[30] Foreign Application Priority Data

Sep. 24, 1997 [KR] Rep. of Korea ..... 97-48558

[51] Int. Cl.[7] ..... G08C 19/00

[52] U.S. Cl. ..... 340/825.72; 359/142; 359/145; 375/316; 375/346

[58] Field of Search ..... 340/825.72, 825.69, 340/310; 359/142, 145, 146; 375/316, 345, 346, 285

[56] References Cited

U.S. PATENT DOCUMENTS 3,614,760 10/1971 Zimmet et al. ..... 340/224

4,232,298 11/1980 Ley ..... 340/825.71

4,426,662 1/1984 Skerlos et al. ..... 358/194.1

5,506,715 4/1996 Zhu ..... 359/147

*Primary Examiner*—Michael Horabik

*Assistant Examiner*—Alton Hornsby

*Attorney, Agent, or Firm*—Samuels, Gauthier & Stevens, LLP

[57] ABSTRACT

A remote control receiving system includes a squaring circuit for squaring the received signal before filtering. The filtered signal is applied to an envelope detector for distinguishing a control signal from external noise. Accordingly, external optical or electrical noise is substantially removed from the control signal such that remote control communication is substantially enhanced.

10 Claims, 4 Drawing Sheets

REMOTE CONTROL RECEIVING SYSTEM

BACKGROUND OF THE INVENTION

In a conventional remote control receiving system, infrared control signals are transmitted between a remote control source and receiver. The signals are characterized by custom codes and carrier signals. As illustrated in the block diagram of FIG. 1, the infrared control signals are received together with external disturbances, for example optical noise and electrical noise, and the received signals are converted to electrical signals by a photo-detector 11. The converted electrical signals are processed and amplified by a head amplifier 12. The amplified signals, including infrared control signals, optical noise and electrical noise are limited to a predetermined magnitude by a limiter 13. A band pass filter (BPF)/band rejection filter (BRF) 14 attenuates the level of the external noise and amplifies the control signal. An envelope detector 15 tracks the portion, or envelope, of the control signal which has passed through the BPF/BRF 14, using the difference in level between a control signal interval and a NULL interval (noise interval). A comparator 16 reproduces the custom code from the detected envelope.

When external noise is received at photodetector 11, the head amplifier 12 amplifies not only the control signal, but also the noise as well, which can lead to system malfunction. In some cases, the head amplifiers 12 may include a bandpass filter to eliminate some of the noise. However, where the external noise is of a frequency similar to that of the infrared control signal carrier of 38 KHz, for example noise generated by a second harmonic of a TV horizontal fly-back signal or an inverter fluorescent lamp signal, that external noise can still interfere with system operation.

When the frequency of the noise is within the passband of the filter, or when the level of the noise is relatively higher than the infrared control signal, the signal passing through the limiter 13 may include more than the signal carrier, making it difficult to distinguish an envelope from the limiter output. Accordingly, a second harmonic of a TV horizontal fly-back signal or an inverter fluorescent lamp signal may still cause system malfunction. In some systems, the envelope of the control signal and noise is reproduced using an automatic gain controller instead of the limiter. However, in the case where the noise has a frequency similar to that of the control signal, the system exhibits the same shortcomings as a system employing a limiter. Furthermore, an automatic gain controller involves a complicated circuit, which, in an integrated configuration, increases the surface area occupied by the chip.

SUMMARY OF THE INVENTION

The present invention is directed to a remote control receiving system, and more particularly, to a remote control receiving system in which external optical or electrical disturbance is effectively removed.

To address the limitations of the prior art, it is an object of the present invention to provide a remote control receiving system for removing external optical disturbance and electrical noise from a received signal including an infrared control code regardless of the noise frequency and level, and to thereby reproduce the infrared control code without errors.

The present invention comprises a remote control receiving system and a method for processing received optical signals in such a system. The apparatus of the invention comprises a converter for converting an optical signal to an electrical signal. The optical signal includes a control signal and a noise signal. A signal squaring circuit is coupled to the converter for exponentially amplifying the converted electrical signal to generate an exponential signal. A filter processes the exponential signal to substantially pass a portion of the exponential signal in the frequency band of the control signal. An envelope detector tracks the envelope of the control signal to the substantial exclusion of the noise signal, according to the difference in level between a control signal interval and a noise interval of the filtered signal.

In a preferred embodiment, the exponential amplification involves a squaring of the converted electrical signal. A preferred embodiment further comprises an amplifier for amplifying the level of the filtered signal. The filter may comprise a band rejection filter for rejecting a portion of the exponential signal in the frequency band of the noise signal. The band rejection filter may be tuned to reject the frequency of a known noise source, for example the carrier frequency of an inverter fluorescent lamp.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
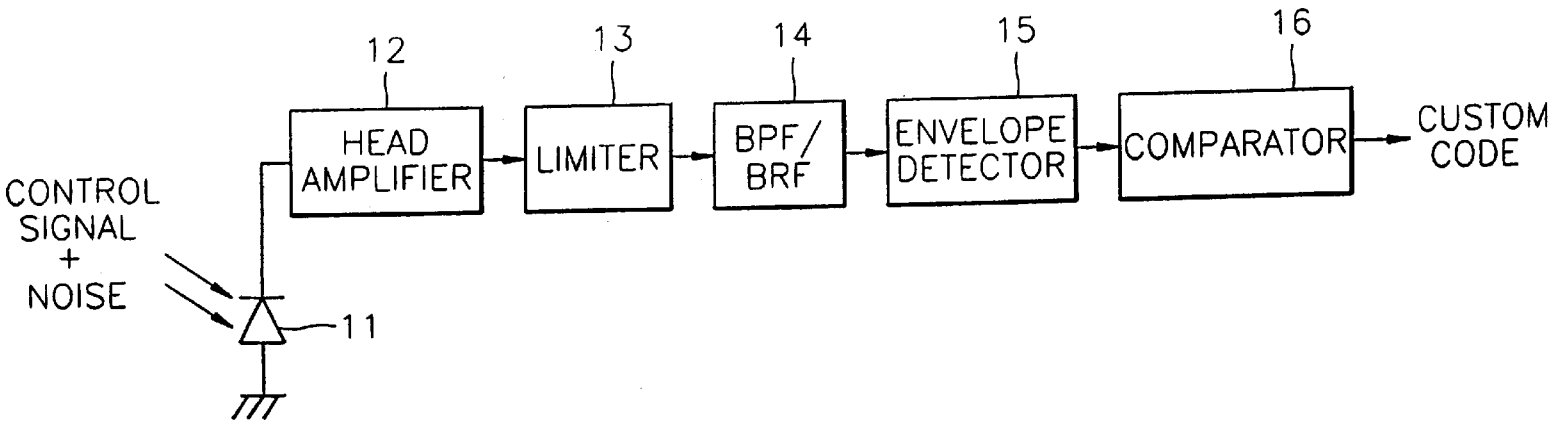
FIG. 1 (PRIOR ART)
FIG. 1 is a block diagram of a conventional remote control receiving system.
Figure 2:
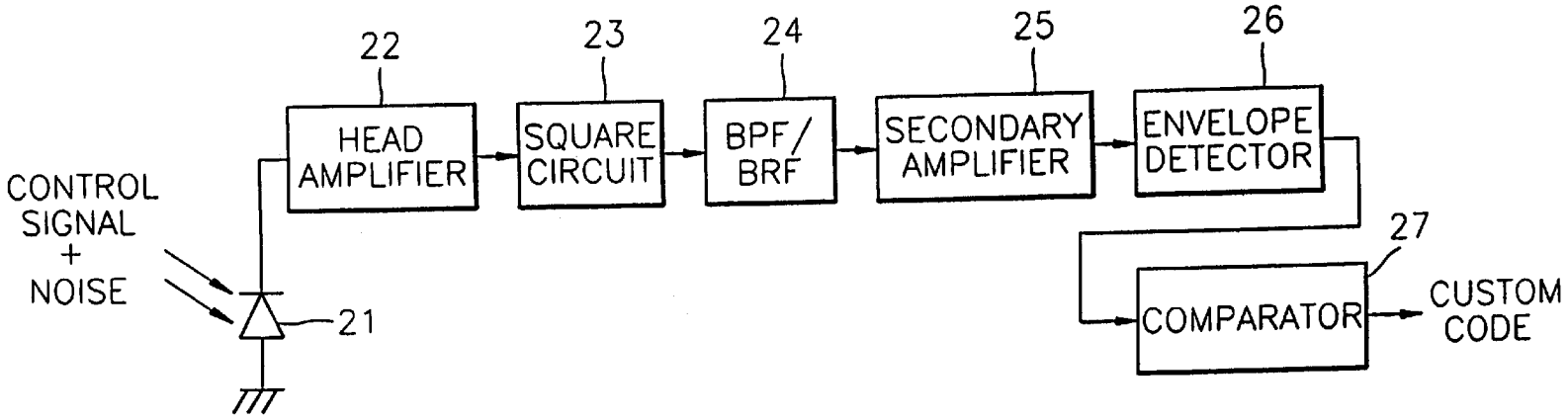
FIG. 2 is a block diagram of a remote control receiving system according to the present invention.

FIG. 2 is a block diagram of a preferred embodiment of a remote control receiving system in accordance with the present invention. The preferred embodiment includes a square circuit 23 and a secondary amplifier 25. An infrared control signal, composed of a custom code and a carrier signal, is received from an external transmitting system such as a remote controller, together with an external disturbance signal at an optical converter. The optical converter, such as a photo-detector 21, converts the input signals to electrical signals. The photo-detector 21 typically comprises a PN diode or a PIN diode. The electrical signals are applied to and amplified at a head amplifier 22. The head amplifier 22 preferably has transfer impedance characteristics of a high gain of 40~50 dB, and is preferably configured as a low noise amplifier suitable for detecting very-low-power optical signals.

A square circuit 23 squares the output signal of the head amplifier 22 and generates a squared signal output, which is applied to bandpass filter (BPF) 24 for amplifying the squared signals in the frequency band of the control signal and further applied to a band rejection filter (BRF) 24 for rejecting the squared signal in the frequency band of noise. The band rejection filter (BRF) may optionally include a filter for rejecting a carrier frequency of an inverter fluorescent lamp, or other commonly-encountered external noise source having a frequency similar to the control signal carrier.

The secondary amplifier 25 amplifies the level of the output signal of the filter 24, thereby increasing the signal level reduced by squaring at square circuit 23. An envelope detector 26 tracks the envelope of the control signal among the filtered and amplified signals according to the difference in level between the control signal interval and the noise signal interval. The noise interval is an interval where only the noise exists without the control signal, in other words, a NULL interval. The comparator 27 then reproduces the custom code.

The operation and effect of the square circuit of FIG. 2 will now be described. It is assumed that an input control signal $V_s(t)$ is expressed by:

$$V_s(t)=A\cos\omega_1 t, \tag{1}$$

and input noise $V_n(t)$ is expressed by:

$$V_n(t)=B\cos\omega_2 t. \tag{2}$$

The squared control signal $V_s^2(t)$ as processed by square circuit 23 is expressed by:

$$V_s^2(t) = A^2\cos^2 w_1 t = \frac{A^2}{2} + \frac{A^2}{2}\cos 2w_1 t. \tag{3}$$

After passing through the bandpass filter 24 of $2\omega_1$, the $A^2/2$, or DC, portion of the signal is attenuated, and the resulting filtered squared control signal is expressed by:

$$\frac{A^2}{2}\cos 2w_1 t. \tag{4}$$

Figure 3A:
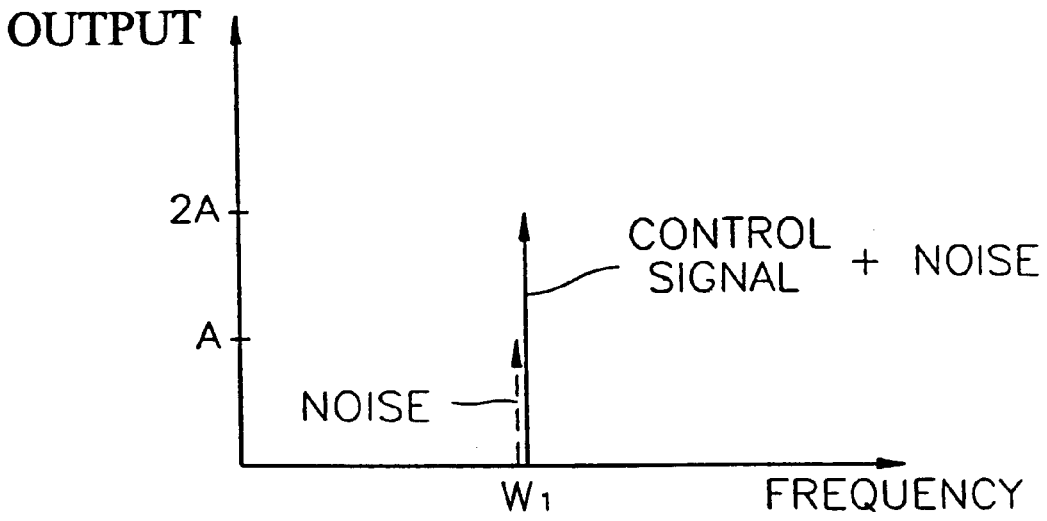
FIG. 3A is a chart of noise and signal levels obtained by mixing a control signal and external noise, before squaring, in acccordance with the present invention.
Figure 3B:
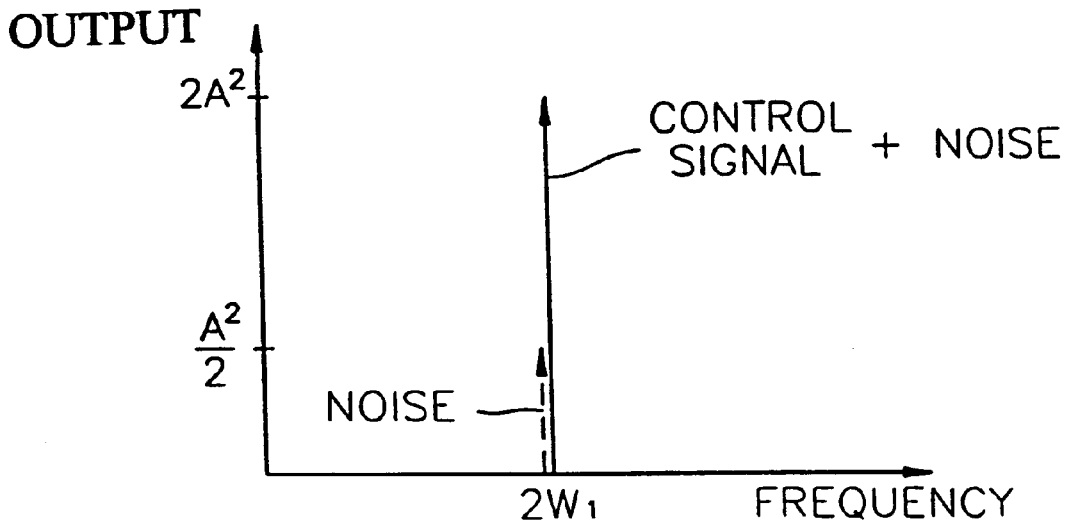
FIG. 3B is a chart of noise and signal levels obtained by mixing a control signal with external noise, after squaring, in accordance with the present invention.

Accordingly, the maximum output level of the control signal is $A^2/2$ as shown in FIG. 3B.

The squared noise $V_n^2(t)$ as processed by square circuit 23 is expressed by:

$$V_n^2(t) = B^2\cos^2 w_2 t = \frac{B^2}{2} + \frac{B^2}{2}\cos 2w_2 t. \tag{5}$$

After passing through the bandpass filter 24 of $2\omega_2$ the $B^2/2$, or DC portion of the signal is attenuated, and the resulting control signal is expressed by:

$$\frac{B^2}{2}\cos 2w_2 t. \tag{6}$$

Accordingly, the maximum output level of the noise is $B^2/2$ as shown in FIG. 3B.

In an interval where the control signal $V_s(t)$ and the noise $V_n(t)$ are received in combination, the input signal $V_{in}(t)$ is expressed by:

$$V_{in}(t)=V_s(t)+V_n(t)=A\cos\omega_1 t+B\cos\omega_2 t. \tag{7}$$

The squared input signal $V_{in}(t)^2$ is expressed by:

$$\begin{aligned} V_{in}(t)^2 &= V_s(t)^2 + V_n(t)^2 + AB\cos(w_1 t + w_2 t) + \cos(w_1 t - w_2 t) \\ &= \frac{A^2}{2} + \frac{A^2}{2}\cos w_1 t + \frac{B^2}{2} + \frac{B^2}{2}\cos w_2 t \end{aligned} \tag{8}$$

After rejecting a DC component of the squared signal $V_{in}(t)^2$ at band reject filter BRF 24, the remaining signal is expressed by:

$$\frac{A^2}{2}\cos w_1 t + \frac{B^2}{2}\cos w_2 t + AB\cos(w_1 t + w_2 t) + \cos(w_1 t - w_2 t) \tag{9}$$

Assuming that the level of the control signal is equivalent to the level of the noise, i.e. A=B and assuming the frequency of the control signal is equivalent to the frequency of the noise, i.e. $\omega_1=\omega_2$, after the squared input signal $V_{in}(t)^2$ passes through the band pass filter of $2\omega_1$, the output signal $V_{out}(t)$ is expressed by:

$$V_{out}(t)=2A^2\cos 2\omega_1 t \tag{10}$$

Accordingly, as a result of the squaring circuit 23 the maximum level of the output signal including both control signal and noise becomes $2A^2$ as shown in FIG. 3B.

In FIG. 3A, without squaring, the envelope magnitude in the control signal interval (2A) is double of that in the noise interval, often referred to in the art as a NULL interval (A), assuming that the amplitudes and frequencies of the control signal and noise signal are the same, A=B and $\omega_1=\omega_2$ respectively.

Referring to FIG. 3B, after squaring the input signal at square circuit 23, the level of the noise $V_n(t)^2$ in the envelope is $A^2/2$, and the level of a signal $V_s(t)^2$ obtained by mixing the control signal and the noise is $2A^2$. The difference between signals is four-fold, which corresponds to an improvement of 6 dB.

When a sinusoidal signal $B\sin\omega_1 t$ is input as noise, the above effect is not realized. However, the phase of the noise is random, so it is extremely unlikely that the frequency of the noise would be equivalent to that of the control signal and that the difference in phase between the noise and the control signal would be 90°.

As described above, the square circuit 23 allows the control signal interval and the NULL interval to be positively distinguished by their respective envelopes, regardless of the level and frequency of the noise. Therefore, the square circuit is effective for any of a number of systems which reproduce a code carried by the transfer carrier using an envelope, including a remote control receiving system.

Figure 4A:
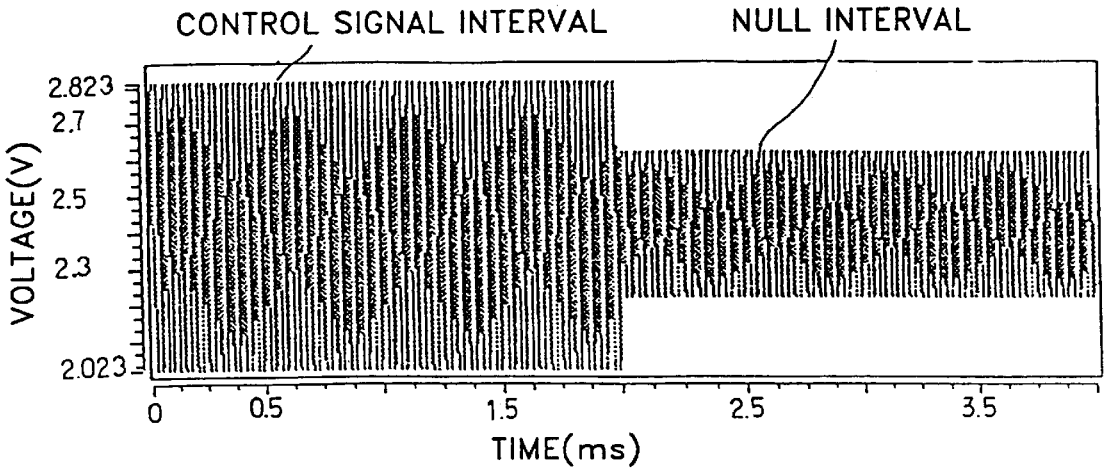
FIGS. 4A, 4B, and 4C are charts of voltage (V) as a function of time (ms) in the form of simulation results which demonstrate the difference between the envelopes of signals before and after squaring, in accordance with the present invention.
Figure 4B:
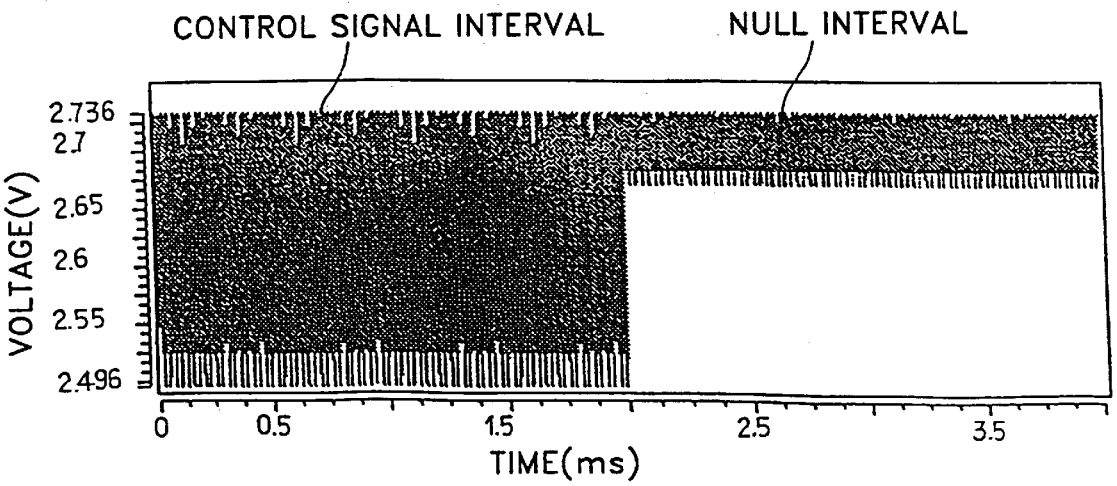
Figure 4C:
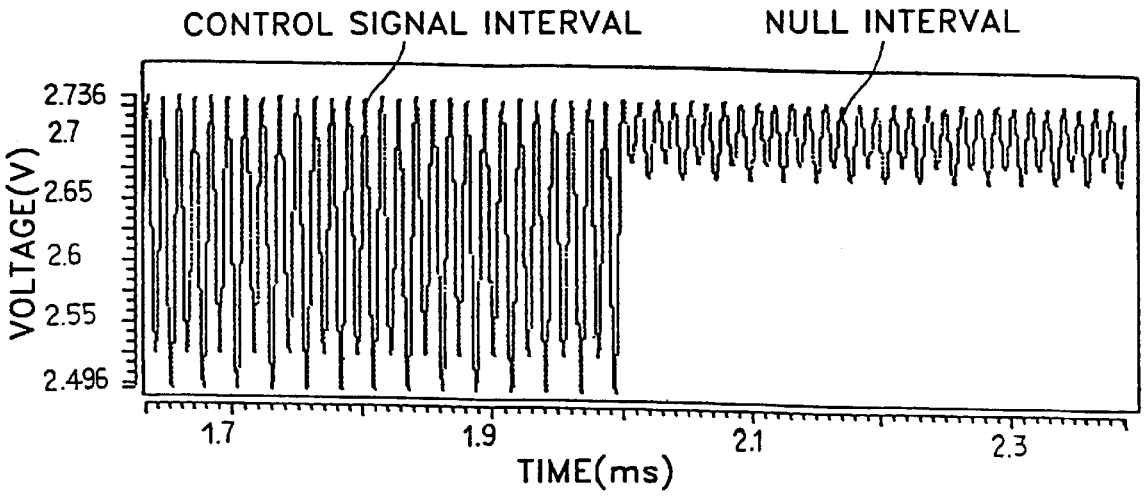

FIG. 4A illustrates a signal obtained by mixing a control signal of 0.4 Vpp (Volts peak-to-peak), fs=38 KHz and a noise signal of 0.4 Vpp, fr=38 KHz. FIG. 4B shows an output signal obtained by the square circuit, and FIG. 4C shows the signal detected by the filter.

Referring to FIG. 4A, it is assumed that the control signal is received for the interval from 0 ms to 2 ms, under conditions of continuous noise. Thus, the interval following 2 ms is a NULL interval, i.e., a noise interval. Before squaring, the signal-to-noise ratio (SNR) is 1. The signal level during the control signal interval is 0.8 Vpp and the signal level during the noise interval is 0.4Vpp.

In FIG. 4B, after squaring, the ratio of the difference in envelope between the control signal interval and the noise interval is larger. For example, the level of the signal during the control signal interval is 0.24 Vpp, and the level of the signal in the noise interval is 0.064 Vpp. The output signal is given in FIG. 4C. Therefore, after squaring, the signal magnitude in the control signal interval is four times larger (FIG. 4B) than that in the noise interval, as opposed to two times larger before squaring (FIG. 4A). It is therefore shown that the control signal can be clearly distinguished from the noise according to the present invention.

As described above, according to the remote control receiving system of the present invention, the control signal received together with the noise is filtered through a square circuit, to thereby accurately reproduce a control code regardless of the frequency or level of external noise such as optical noise or EMI disturbance.

While this invention has been particularly shown and described with references to preferred embodiments thereof, it will be understood by those skilled in the art that various changes in form and details may be made therein without departing from the spirit and scope of the invention as defined by the appended claims.

For example, the squaring circuit 23 can be employed in any of a number of configurations suitable for squaring an input signal. The squaring circuit 23 is not necessarily limited to a squaring function and may comprise any exponential function, where the exponent is greater than 1, to realize the exponential advantage in SNR.

What is claimed is:

1. A remote control receiving system comprising:

a converter for converting an optical signal to an electrical signal, said optical signal including a control signal and a noise signal;

a signal squaring circuit coupled to the converter for exponentially amplifying the converted electrical signal to generate an exponential signal;

a filter coupled to the signal squaring circuit for processing the exponential signal to substantially pass the portion of the exponential signal in the frequency band of the control signal and for outputting the filtered signal; and an envelope detector for tracking the envelope of the control signal to the substantial exclusion of the noise signal according to the difference in level between a control signal interval and a noise interval of the filtered signal.

2. The remote control receiving system of claim 1, wherein the exponential amplification comprises squaring of the converted electrical signal.

3. The remote control receiving system of claim 1, further comprising an amplifier for amplifying the level of the filtered signal.

4. The remote control receiving system of claim 1, wherein the filter further comprises a band rejection filter for rejecting a portion of the exponential signal in the frequency band of the noise signal.

5. The remote control receiving system of claim 3, wherein the band rejection filter is tuned to reject a carrier frequency of an inverter fluorescent lamp.

6. A method for processing received optical signals in a remote control receiving system comprising:

converting an optical signal to an electrical signal, said optical signal including a control signal and a noise signal;

exponentially amplifying the converted electrical signal to generate an exponential signal;

filtering the exponential signal to permit a portion of the exponential signal substantially in the frequency band of the control signal to pass; and tracking the envelope of the control signal to the substantial exclusion of the noise signal according to the difference in level between a control signal interval and a noise interval of the filtered signal.

7. The method of claim 6, wherein exponentially amplifying comprises squaring of the converted electrical signal.

8. The method of claim 6 further comprising amplifying the level of the filtered signal.

9. The method of claim 6 further comprising filtering the squared signal to reject a portion of the exponential signal in the frequency band of the noise signal.

10. The method of claim 9 wherein the frequency band is tuned to reject a carrier frequency of an inverter fluorescent lamp.

* * * * *

UNITED STATES PATENT AND TRADEMARK OFFICE

CERTIFICATE OF CORRECTION

PATENT NO. : 6,121,893
DATED : September 19, 2000
INVENTOR(S) : Jae-ho Park

It is certified that error appears in the above-identified patent and that said Letters Patent is hereby corrected as shown below:

Column 5,
Lines 31 and 34, please replace “signal squaring circuit” with -- signal amplifier --.

Signed and Sealed this

Twenty-first Day of January, 2003

JAMES E. ROGAN
*Director of the United States Patent and Trademark Office*